US007337898B2

(12) United States Patent
Lewter

(10) Patent No.: US 7,337,898 B2
(45) Date of Patent: Mar. 4, 2008

(54) GOLF BAG

(76) Inventor: Fred Lewter, 475 Barrington Grange Dr., Sharpsburg, GA (US) 30277

( * ) Notice: Subject to any disclaimer, the term of this patent is extended or adjusted under 35 U.S.C. 154(b) by 505 days.

(21) Appl. No.: 10/675,849

(22) Filed: Sep. 30, 2003

(65) Prior Publication Data

US 2004/0074791 A1 Apr. 22, 2004

(51) Int. Cl.
*A63B 55/00* (2006.01)
*A63B 55/04* (2006.01)

(52) U.S. Cl. ..... 206/315.3; 211/70.2; 206/315.6; 206/315.7

(58) Field of Classification Search ..... 206/315.3, 206/315.7, 315.6, 315.4; 211/70.2
See application file for complete search history.

(56) References Cited

U.S. PATENT DOCUMENTS 1,325,692 A * 12/1919 Cross ..... 206/315.4
1,570,500 A * 1/1926 Kennedy ..... 206/315.6
2,070,254 A * 2/1937 Burgner ..... 211/70.2
2,551,780 A * 5/1951 Wood ..... 206/315.3
2,911,228 A * 11/1959 Green ..... 280/655
3,316,951 A * 5/1967 Jacobson ..... 206/315.3
3,620,546 A * 11/1971 Andersen ..... 280/40
4,655,346 A 4/1987 Reinholz
4,858,761 A 8/1989 Fumia
5,074,576 A 12/1991 Finlay
5,123,531 A 6/1992 Beretta
5,415,284 A 5/1995 King
5,582,290 A 12/1996 McCuaig et al.
5,868,247 A 2/1999 Schrader
6,352,154 B1 * 3/2002 Miura ..... 206/315.6
6,659,477 B2 * 12/2003 Jung ..... 280/47.26
2002/0066763 A1 6/2002 Hsueh
2002/0115494 A1 8/2002 Tan

* cited by examiner

*Primary Examiner*—Tri M. Mai
(74) *Attorney, Agent, or Firm*—Myers & kaplan, LLC; Ash D. Patel

(57) ABSTRACT

An improved golf bag that upon frontal opening promotes the pivoted gravitational falling and forward, limited angular displacement of a plurality of tiered racks adapted to receive and maintain stationary placement of a plurality of golf clubs therein, thereby providing convenient and organized frontal presentation and accessibility to a variety of golf clubs, and wherein the golf bag is adapted to be seated and secured to the rear of a golf cart without external harnesses or straps, thus permitting the bag to extend beyond the rear of golf cart and provide free frontal access to the contents thereof.

15 Claims, 15 Drawing Sheets

GOLF BAG

TECHNICAL FIELD

The present invention relates generally to golfing equipment, and more specifically to a golf bag that, among other features, advantageously provides frontal access to a plurality of tiered racks adapted to receive and removably retain a plurality of golf clubs therein, thereby preventing the jostling and contact amongst same, and the resulting damage thereto, during transport of the golf bag.

BACKGROUND OF THE INVENTION

Conventional golf bags have historically provided golfers with a suitable apparatus for storing and transporting golf clubs both during play and thereafter. However, because the club heads are often exposed and/or protrude from the top of most such golf clubs, such bags are inherently deficient in their ability to protect the golf club from structural damage via forceful impact and/or collision of the clubs with one another, or with external surfaces during transport of the clubs and golf bag in a golf cart, within the trunk of vehicle, or the cargo/luggage storage bay of an aircraft. Such forceful impact to the golf clubs may impart significant axial damage to club shaft, and structural damage to the golf head. Moreover, because many such golf bags employ tubular slots or housings for each club, clubs placed therein are subject to jostling and movement therein during transport of the bag, thereby causing facial or surface damage to the club shaft (especially easily scratched graphite shafts), or result in the club sliding out therefrom during transport of the bag in a vehicle or the like, and thus, subsequent damage thereto.

Although both soft and hard case protective golf bag covers that fully enclosed the golf bag are available, such covers do not preclude potentially destructive movement or jostling of the clubs carried within the tubular housings of the golf bag, or the harmful striking of the club heads against one another. As such, the clubs may still slidable move within the tubular housings, thereby resulting in surface damage to the shaft. Moreover, should a soft cover be selected, axial damage to the club shafts is still a possibility.

In an effort to reduce harmful striking, impact and/or contact of the club heads with one another, and to protect the club heads from unexpected harsh elements of weather, many golfers utilize padded club head covers that individually engage and cover each golf club head. Although effective in deterring harmful scathing or contact between the club heads, such head covers still do not preclude the potential of axial damage to the club shaft via external impacting forces.

Still another deficiency associated with conventional golf bags is the poor presentation, removability and accessibility of the clubs, thereby often contributing or lending to structural and facial damage to the golf club shafts. Specifically, because most golf bags utilize long, tubular slots to house each club, and because most such slots are arranged within a generally circular configuration due to the generally cylindrical structure or shape of the golf bag, golfers must remove a club from the bag by drawing the shaft up through the tubular slot. However, due to the average length of such clubs, and the typical reach or upward arm's length stretch of the average adult golfer, removal of the club in such a manner often results in the club being drawn or pulled from the tubular slot at an angle (i.e., as opposed to directly upward), and therefore, imparts an undesirable yield stress on the shaft as the shaft is pulled up through and against the tubular housing. Such removal also causes facial or surface damage to the club shaft. Replacement of the golf club within such tubular slots is conducted in a similar manner, angle and motion, wherein most such golfers typically release the club when recessed within tubular slot sufficient distance, letting it forcefully drop therewithin, or, alternatively, forcefully thrust the club back into the tubular housing, thereby further subjecting the club shaft to undesirable yield stress and axial force.

Therefore, it is readily apparent that there is a need for an improved golf bag that replaces conventional apparatuses and methods of golf club storage, transportation, and retrieval by advantageously eliminating conventional use of tubular housings or slots to retain and store clubs during transport, thereby preventing the harmful jostling and contact amongst same, and wherein a plurality of tiered racks adapted to receive and maintain stationary placement of a plurality of golf clubs therein provide convenient frontal accessibility to the golf clubs, yet protect the golf club heads from harmful scathing or contact between one another. There is still a further need for an improved golf bag that protects the golf shaft from undesirable yield stress during removal of the club from the bag, from external forces that may impart undesirable axial stress on the golf shaft, and from the harsh elements of weather or other external forces that damage otherwise exposed golf club heads. There is yet still a further need for an integrated or combined golf club storage and transportation device.

BRIEF SUMMARY OF THE INVENTION

Briefly described, in a preferred embodiment, the present invention overcomes the above-mentioned disadvantages and meets the recognized need for such a device by providing an improved golf bag that upon frontal opening promotes the pivoted gravitational falling and forward, limited angular displacement of a plurality of tiered racks adapted to receive and maintain stationary placement of a plurality of golf clubs therein, thereby providing convenient and organized frontal presentation and accessibility to a variety of golf clubs, and wherein the golf bag is adapted to be seated and secured to the rear of a golf cart without external harnesses or straps, thus permitting the bag to extend beyond the rear of golf cart and provide free frontal access to the contents thereof.

According to its major aspects and broadly stated, the present invention in its preferred form is a golf bag having a housing comprising a plurality of tiered racks and golf accessory compartments, an externally located adjustable bracket, a golf cart seating notch disposed on the bottom of the housing, a wheeled base, and handle.

More specifically, the present invention is a golf bag having a housing comprising a tri-tiered rack system, wherein a first rearwardly disposed rack, preferably integrally formed with the housing, is adapted to receive and cover a plurality of "wood" golf clubs, and wherein a second and third rack, each preferably pivotally connected to the housing base, are adapted to receive "iron" clubs and "wedge" clubs, respectively. Preferably, the first and second rack comprise a base tray having a plurality of open-faced grooves, recesses or slots, wherein the open-face of each groove or slot is preferably covered via resilient fabric, or the like, for effectuating an outer retaining wall thereover. Each slot of the first and second rack trays is preferably dimensioned to retain the upper-most portion of the handle of a club, wherein forward dislodgement of the club handle from a respective slot is precluded via the outer fabric retaining wall affixed thereover. The third rack also preferably possesses a base tray functionally, and substantially structurally, equivalent to the base trays of the first and second rack; however, the slots or recesses formed in the base tray of the third rack are preferably fully closed (i.e., cylindrical-shaped recesses or slots) and thus, do not require an overlying fabric retaining wall to preclude forward dislodgement of club handles therefrom. It is, however, contemplated that the base tray of the third rack could alternatively comprise open-faced slots covered via a fabric retaining wall.

Preferably, a portion of each club shaft just aft of each club head is securely and removably engaged within a retaining clasp of a plurality of retaining clasps disposed on the upper region of each rack (i.e., a DELRON retaining clasp system), wherein each clasp of a particular rack is aligned with a corresponding slot formed in the tray of the rack. Additionally, to facilitate recession of each golf club within a particular clasp-and-slot arrangement, a groove extends from each clasp to an aligned slot of the tray, wherein each groove comprises a different, brightly-colored strip of adhesive tape, paint, or the like, to facilitate proper visual alignment of each clasp with a corresponding slot, and thus the proper placement of a club therein. In such a configuration, each golf club placed within the racks of the bag is presented in an organized, spaced-apart, inverted arrangement for ease of removal and replacement of same. Each rack is further preferably lined with a rubber-sponge material, or other padded material, so as to protect the clubs retained therein, wherein rubber-sponge tabs or padded walls extend from the racks to preferably separate each club head to prevent harmful or damaging contact amongst same.

Preferably the second rack is pivotally connected to the base of the bag via a double-hinge, wherein opening of the bag, in conjunction with the weight of the clubs carried by the second rack, results in the gravitational falling and forwardly, limited angular displacement of the second rack. The gravitational falling and angular displacement of the second rack is preferably limited via pivot hinges, or the like, extending from the second rack to the sides of the housing, wherein the pivot hinges preferably limit the angular displacement of the second rack to an approximately 75 degree angle relative to the base of the golf bag.

Preferably, the third rack is also pivotally connected to the base of the bag via a bearing hinge, or the like, and thus also gravitationally falls forward upon opening of the bag, preferably into an approximately 60 degree angle relative to the base of the golf bag. The forward angular displacement of the third rack is preferably limited via pivot hinges, or the like, extending from the third rack to the sides of the housing. The forward angular displacement of the third rack is further preferably limited upon contact of the bottom edge of the rack with the base of the bag, and via a relatively large storage compartment removably affixed on the forward face thereof. Additionally, it is contemplated that the gravitational falling and pivoting of the second rack may assist in pushing against the third rack, and thus, promote the gravitational falling or pivoting of same into a forwardly angled position.

An adjustable "hook-shaped" bracket is preferably disposed on the rear side of the housing for facilitating engagement of the bag to horizontal bars formed on the rear chassis of conventional golf carts, wherein the bracket is preferably adjustable from heights of approximately 31 inches to approximately 36 inches from the base of the bag so as to accommodate all current makes and models of golf carts. Additionally, to facilitate the secured engagement of the bag to the rear of the golf cart, a groove or notch is preferably formed on the underside of the base of the bag, wherein the notch is preferably dimensioned to engage an outer-most ridge or wall of a conventional golf bag storage area formed on most golf carts. Such a configuration preferably permits the bag to extend beyond the rear of the golf cart and provide free frontal access to the contents thereof.

The housing of golf bag further preferably possesses rear mounted wheels that sit preferably approximately 1 inch from the ground when the base of the golf bag seated substantially flush with the ground, wherein the wheels become operative preferably upon tilting the bag beyond an approximately 65 degree angle, relative to the ground, via a handle integrally formed at the upper-most rear side of the bag housing.

Furthermore, soft-cover closure flaps of the bag provide central access to the bag via a zipper mechanism, wherein unzipping the closure flaps from top to bottom of the bag results in gravitational falling and pivotal displacement of the racks as described above. The inner surface of each closure flap preferably comprises a plurality of pockets and compartments, each accessible upon "peeling" and fastening back each closure flap via hook-and-loop fasteners, or the like, so as to expose the inner surfaces thereof. It is contemplated in an alternate embodiment that the closure flaps could be in the form of hard-cover closure flaps. It is further contemplated that the closure flaps could comprise a plurality of tensioned ribs so as to facilitate the tensioned closing and opening of same, wherein such an embodiment could further incorporate pivot hinges, or other connecting arms or devices, attached to the second rack to facilitate the outward pushing and gravitational falling of same upon tensioned opening of each closure flap. It is contemplated in still another alternate embodiment that the housing could utilize a single closure flap having a side-disposed zipper mechanism or the like. In yet another alternate embodiment, it is contemplated that the rear of the housing could incorporate an extendable rain cover adapted to shield the bag in either an opened or closed state.

An alternate embodiment of the present invention contemplates replacing the pivotally-affixed third rack, and the removable storage compartment thereof, with a detachable third rack securely and removably supported by a pivotally-affixed support plate adapted to removably secure a storage compartment thereto. The detachable third rack comprises a stake for securing the rack into the earthen ground, thereby maintaining the rack, and the golf clubs carried thereby, in an upright position and off of wet or dew-covered grass, sand, or the like. The stake of the rack is received by a pocket integrally formed with the rear of the support plate, wherein the forward face of the support plate is adapted to removably secure a storage compartment thereto via hook-and-loop fasteners, or the like. A handle disposed on the rack assists in removing same from the support rack.

Accordingly, a feature and advantage of the present invention is its ability to provide an improved golf bag that upon frontal opening promotes the pivoted gravitational falling and forward, limited angular displacement of a plurality of tiered racks adapted to receive and maintain stationary placement of a plurality of golf clubs therein, thereby providing convenient and organized frontal presentation and accessibility to a variety of golf clubs.

Another feature and advantage of the present invention is its ability to provide an improved golf bag that replaces conventional apparatuses and methods of golf club storage, transportation, and retrieval typically responsible for harmful jostling and contact amongst golf clubs retained therein.

Still another feature and advantage of the present invention is its ability to protect golf club heads from harmful scratching or contact amongst one another.

Yet another feature and advantage of the present invention is its ability to provide an improved golf bag that protects the golf shaft from undesirable yield stress during removal of the club from the bag, from external forces that may impart undesirable axial stress on the golf shaft, and from the harsh elements of weather or other external forces that damage otherwise exposed golf club heads.

Yet still another feature and advantage of the present invention is its ability to provide an externally located adjustable bracket, and a golf cart seating notch disposed on the bottom of the golf bag, to facilitate secured engagement and support of the golf bag to the rear of a golf cart without the need of external straps or harnesses.

A further feature and advantage of the present invention is its ability to provide a golf bag capable of fully enclosing and protecting all contents place therein.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATIVE EMBODIMENTS

Figure 1:
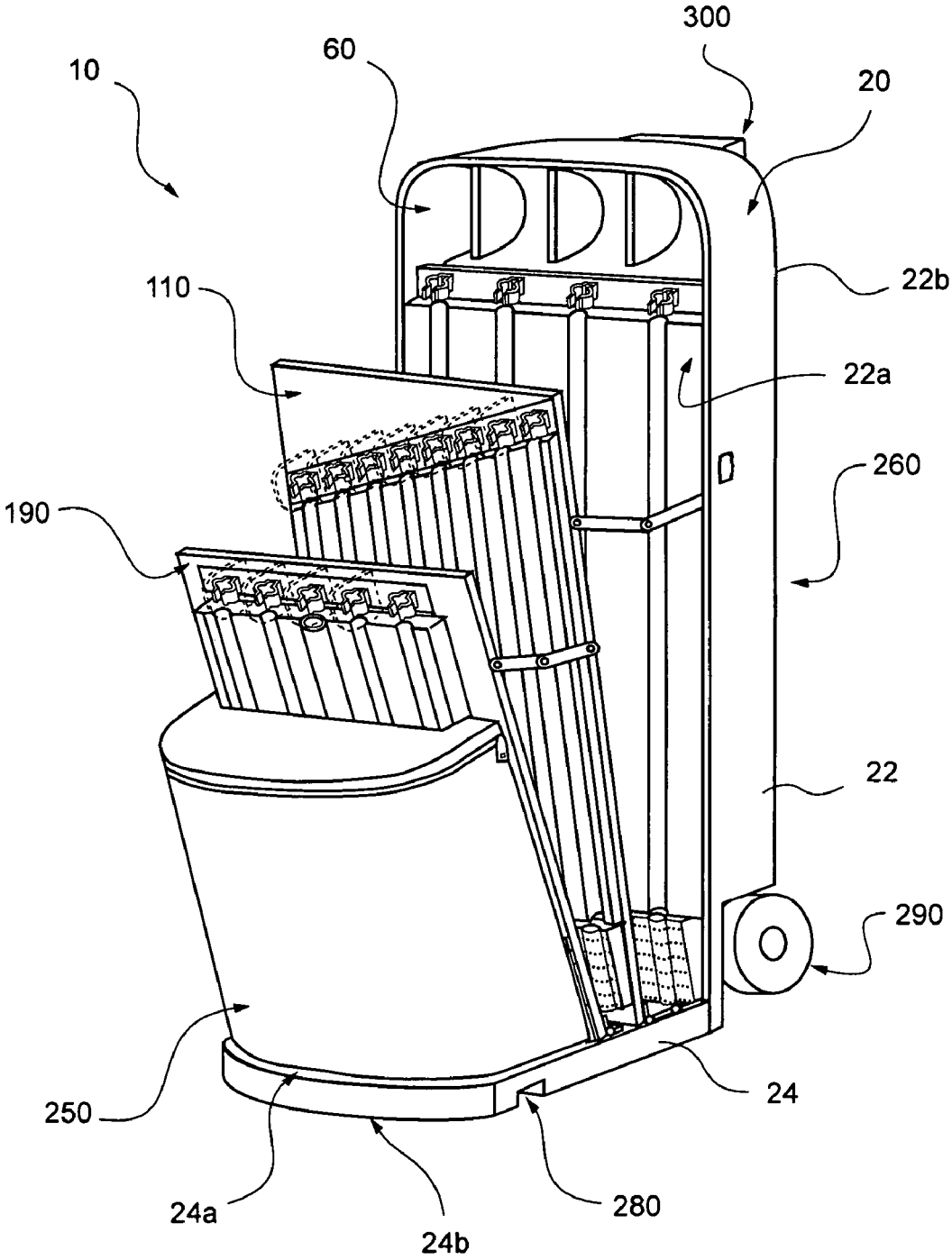
FIG. 1 is a perspective view of a golf bag according to a preferred embodiment of the present invention.

In describing the preferred and alternate embodiments of the present invention, as illustrated in FIGS. 1-8, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1-3B, the present invention in a preferred embodiment is a golf bag 10, generally comprising housing 20, first rack 60, second rack 110, third rack 190, storage compartment 250, adjustable bracket 260, golf cart seating notch 280, wheel assembly 290, handle 300, and front cover 320. More specifically, housing 20 preferably includes upright member 22 integrally formed with, and disposed substantially perpendicular to, base member 24, wherein upright member 22 preferably comprises recessed inner wall 22*a* and exterior wall 22*b*, and wherein base member 24 preferably comprises top side 24*a* and bottom side 24*b*. Housing 20, first rack 60, second rack 110 and third rack 190, in general, are preferably formed from a durable, non-porous, plastic; although other suitable materials could be utilized, such as, for exemplary purposes only, aluminum, titanium, or other light-weight metals, water-sealed and/or finished woods, combinations thereof, and/or the like.

Figure 2:
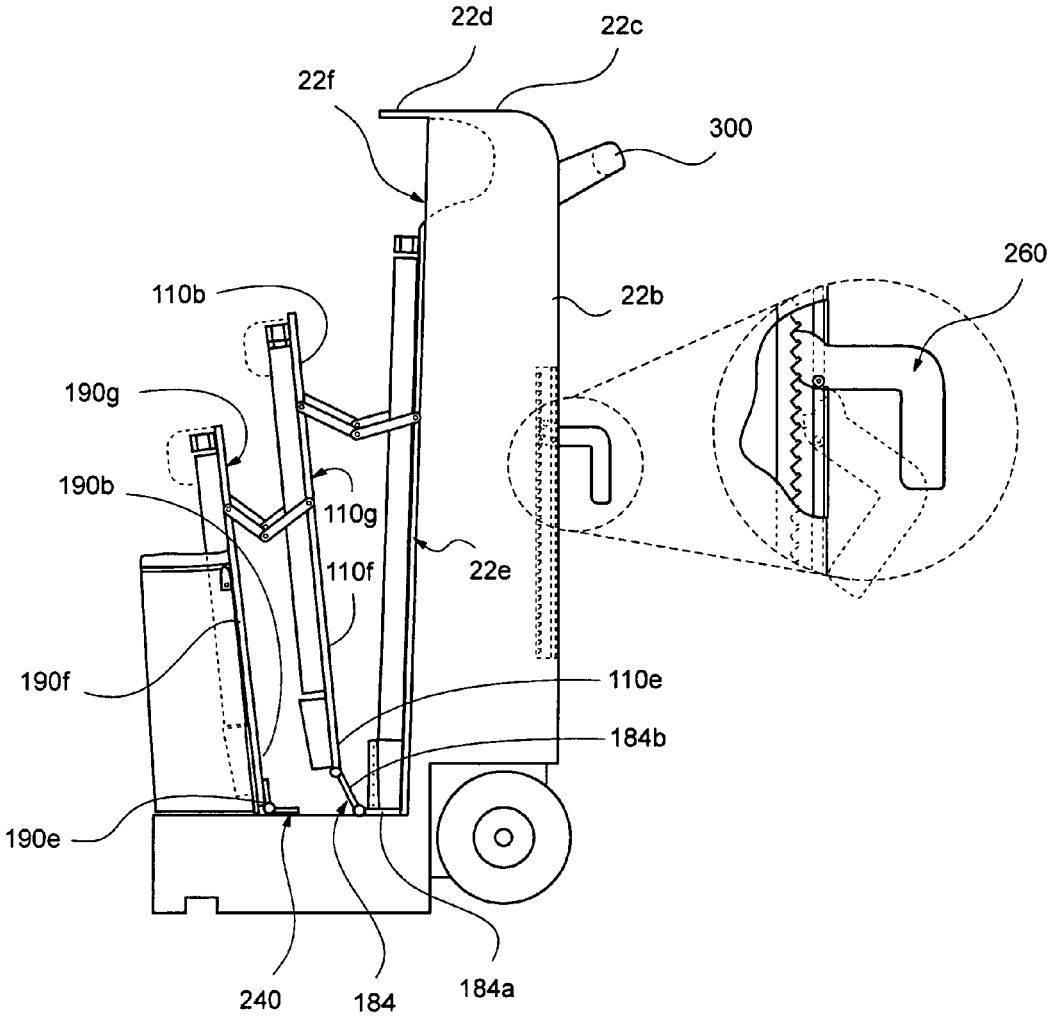
FIG. 2 is a side view of a golf bag according to a preferred embodiment of the present invention.

Preferably integrally formed with recessed inner wall 22*a* of upright member 22 is fixed or stationary first rack 60, wherein club head recesses 62, 64, 66 and 68 are preferably formed in upper portion 60*a* of first rack 60, and preferably dimensioned and adapted to receive and cover the club heads of "wood-type" golf clubs. As best illustrated in FIG. 2, overhang or extension 22*d* preferably extends from, and is integrally formed with, upper wall 22*c* of upright member 22, wherein overhang 22*d* preferably functions to shelter the "wood-type" golf clubs retained within first rack 60, as more fully described below.

Preferably disposed on lower portion 60*b* of first rack 60 is base tray 70, preferably comprising open-faced grooves, recesses or slots 72, 74, 76 and 78. The open-face of each groove or slot 72, 74, 76 and 78 is preferably covered via resilient fabric retaining walls 72*a*, 74*a*, 76*a* and 78*a*, respectively, for effectuating an outer retaining wall thereover, thereby preventing forward and/or lateral dislodgement of golf club handles seated therewithin. Specifically, each slot 72, 74, 76 and 78 preferably comprises a depth dimensioned to retain the upper-most portion of the handle or shaft of a "wood-type" golf club placed therein. It is intended within the primary embodiment that approximately the first 6 inches of the handle portion of a "wood-type" golf club be accommodated within a respective slot; however, it should be recognized that other suitable depths could be utilized to effectuate or facilitate ease of removal and/or retention of a golf club handle placed therein.

Figure 1A:
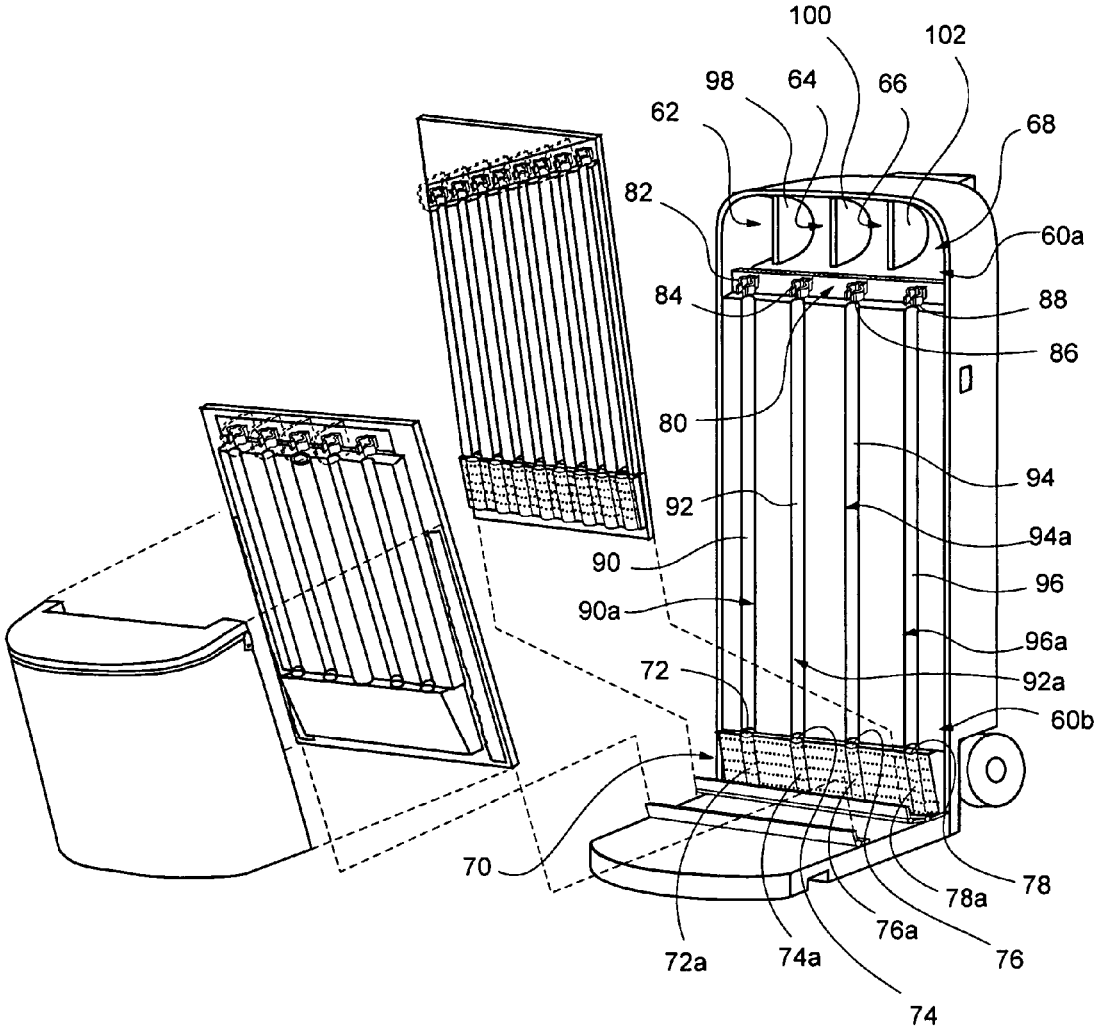
FIG. 1A is an exploded view of a golf bag according to a preferred embodiment of the present invention.

Preferably disposed below club head recesses 62, 64, 66 and 68 are retaining clasps 82, 84, 86 and 88, respectively, preferably extending from, and secured to, retaining bar 80, as best illustrated in FIG. 1A. Retaining clasps 82, 84, 86 and 88 are preferably aligned with slots 72, 74, 76 and 78, respectively, of base tray 70, thereby facilitating substantially vertical retention of "wood-type" golf clubs therein. Specifically, preferably following placement of the handle of a golf club within a selected slot 72, 74, 76 or 78 of base tray 70, the respective retaining clasp 82, 84, 86 or 88 securely receives and removably engages a portion of the golf club shaft just aft of the golf club head.

Additionally, to facilitate recession of each "wood-type" golf club within a particular clasp-and-slot arrangement, grooves 90, 92, 94 and 96 formed in inner wall 22*a* preferably extend from retaining clasps 82, 84, 86 and 88, respectively, to aligned slots 72, 74, 76 and 78, respectively, of base tray 70. Furthermore, grooves 90, 92, 94 and 96 preferably comprise different, brightly-colored strips 90*a*, 92*a*, 94*a* and 96*a* of adhesive tape, paint, or the like, to facilitate proper visual alignment of each clasp 82, 84, 86 and 88 with a corresponding slot 72, 74, 76 and 78, and thus the proper placement of a club therein.

First rack 60 is further preferably lined with a rubber-sponge material, or other padded material, so as to protect the "wood-type" golf clubs retained therein from harmful contact, scratching, scuffing, or the like. Additionally, rubber-sponge or padded dividers 98, 100 and 102, preferably extend from, and are integrally formed with, inner wall 22*a*, thereby functioning to preclude contact amongst the club heads of each "wood-type" golf club stored within rack 60. Specifically, divider 98 is preferably positioned between club head recesses 62 and 64, divider 100 is preferably positioned between club head recesses 64 and 66, and divider 102 is preferably positioned between club head recesses 66 and 68, thereby separating each club head from one another, and preventing harmful or damaging contact amongst same.

With continued reference to FIGS. 1-3B, second rack 110 is preferably adapted to receive and removably retain "iron-type" golf clubs therein. More specifically, preferably formed on front side 110*a* of second rack 110 and disposed on lower portion 110*d* thereof is base tray 112, preferably comprising open-faced grooves, recesses or slots 114, 116, 118, 120, 122, 124, 126 and 128. The open-face of each groove or slot 114, 116, 118, 120, 122, 124, 126 and 128 is preferably covered via resilient fabric retaining walls 114*a*, 116*a*, 118*a*, 120*a*, 122*a*, 124*a*, 126*a* and 128*a*, respectively, for effectuating an outer retaining wall thereover, thereby preventing forward and/or lateral dislodgement of golf club handles seated therewithin. Specifically, each slot 114, 116, 118, 120, 122, 124, 126 and 128 preferably comprises a depth dimensioned to retain the upper-most portion of the handle or shaft of an "iron-type" golf club placed therein. It is intended within the primary embodiment that approximately the first 6 inches of the handle portion of an "iron-type" golf club be accommodated within a respective slot; however, it should be recognized that other suitable depths could be utilized to effectuate or facilitate ease of removal and/or retention of a golf club handle placed therein.

Figure 1B:
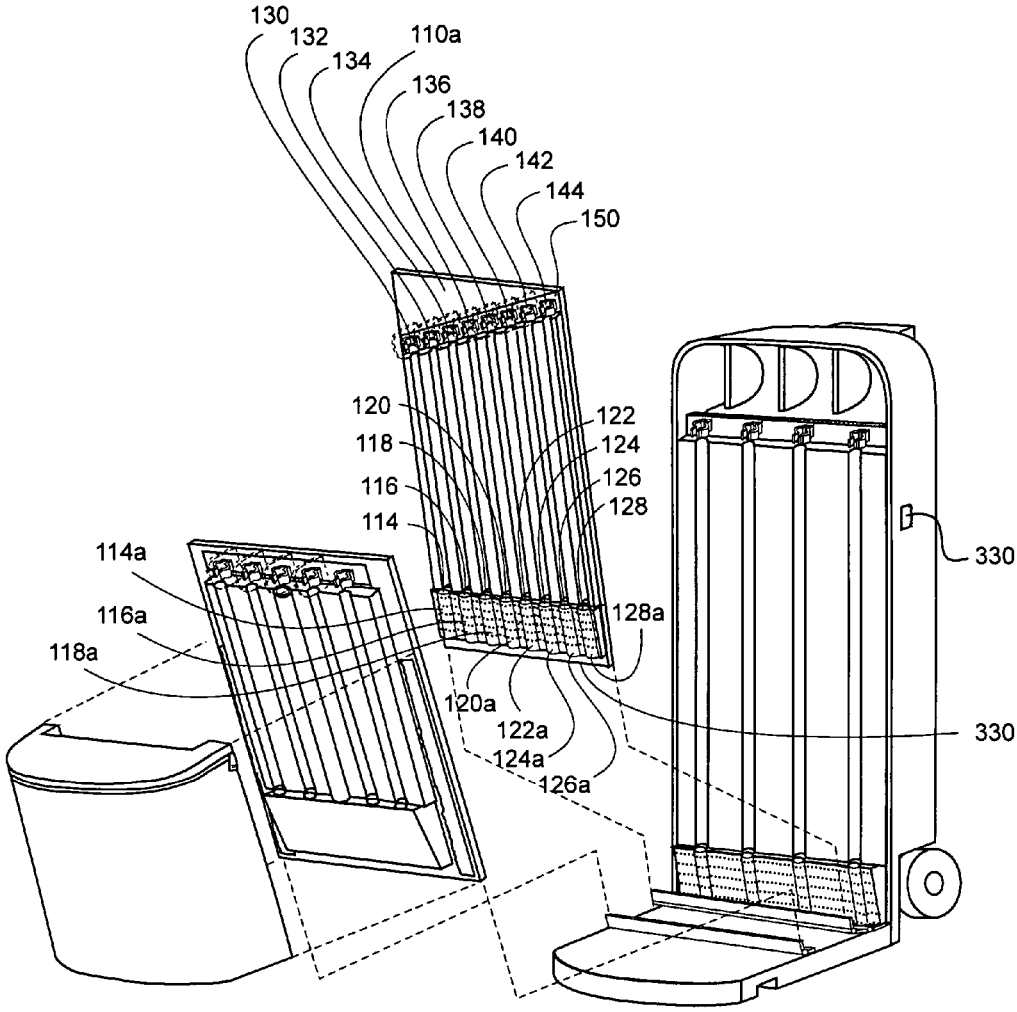
FIG. 1B is an exploded view of a golf bag according to a preferred embodiment of the present invention.

Preferably disposed on upper portion 110*c* of front side 110*a* of second rack 110 is retaining bar 150, preferably having retaining clasps 130, 132, 134, 136, 138, 140, 142 and 144 extending therefrom and secured thereto, as best illustrated in FIG. 1B. Retaining bar 150 is preferably affixed to front side 110*a* at a suitable slant or incline to accommodate the generally increasing height or length of each "iron-type" golf club retained thereby (i.e., a number 2 "iron-type" golf club through a number nine "iron-type" golf club). Retaining clasps 130, 132, 134, 136, 138, 140, 142 and 144 are preferably aligned with slots 114, 116, 118, 120, 122, 124, 126 and 128, respectively, of base tray 112, thereby facilitating substantially vertical retention of "iron-type" golf clubs therein. Specifically, preferably following placement of the handle of a golf club within a selected slot 114, 116, 118, 120, 122, 124, 126 or 128 of base tray 112, the respective retaining clasp 130, 132, 134, 136, 138, 140, 142 or 144 securely receives and removably engages a portion of the golf club shaft just aft of the golf club head.

Additionally, to facilitate recession of each "iron-type" golf club within a particular clasp-and-slot arrangement, grooves 152, 154, 156, 158, 160, 162, 164 and 166 formed in front side 110*a* preferably extend from retaining clasps 130, 132, 134, 136, 138, 140, 142 and 144, respectively, to aligned slots 114, 116, 118, 120, 122, 124, 126 and 128, respectively, of base tray 112. Furthermore, grooves 152, 154, 156, 158, 160, 162, 164 and 166 preferably comprise different, brightly-colored strips 152*a*, 154*a*, 156*a*, 158*a*, 160*a*, 162*a*, 164*a* and 166*a* of adhesive tape, paint, or the like, to facilitate proper visual alignment of each clasp 130, 132, 134, 136, 138, 140, 142 and 144 with a corresponding slot 114, 116, 118, 120, 122, 124, 126 and 128, and thus the proper placement of a club therein.

Second rack 110 is also preferably lined with a rubber-sponge material, or other padded material, so as to protect the "iron-type" golf clubs retained therein from harmful contact, scratching, scuffing, or the like. Additionally, rubber-sponge or padded dividers 170, 172, 174, 176, 178, 180 and 182, preferably extend from, and are integrally formed with, front side 110*a*, thereby functioning to preclude contact amongst the club heads of each "iron-type" golf club stored within rack 110. Specifically, divider 170 is preferably positioned between clasps 130 and 132, divider 172 is preferably positioned between clasps 132 and 134, divider 174 is preferably positioned between clasps 134 and 136, divider 176 is preferably positioned between clasps 136 and 138, divider 178 is preferably positioned between clasps 138 and 140, divider 180 is preferably positioned between clasps 140 and 142, and divider 182 is preferably positioned between clasps 142 and 144, thereby separating each club head from one another, and preventing harmful or damaging contact amongst same.

Preferably, and as best illustrated in FIG. 2, second rack 110 is pivotally connected to top side 24*a* of base member 24 of housing 20 via double-hinge 184. Specifically, first portion 184*a* of double-hinge 184 is pivotally connected to top side 24*a* of base member 24, proximal to fixed base tray 70 of first rack 60, wherein second portion 184*b* of double-hinge 184 is preferably pivotally connected to rear side 110*b* of second rack 110, proximate bottom edge 110*e* thereof. Preferably, and as more fully described below, the opening of bag 10, in conjunction with the weight of the "iron-type" golf clubs carried by second rack 110, results in the gravitational falling and forwardly, limited angular displacement of second rack 110. The gravitational falling and angular displacement of second rack 110 is preferably limited via pivot hinges 186 and 188, or the like, extending from side edges 110*f* and 110*g*, respectively, of second rack 110 to front inner edges 22*e* and 22*f* of upright member 22 of housing 20. Preferably, pivot hinges 186 and 188 limit the gravitational falling and angular displacement of second rack 110 to an approximately 75 degree angle relative to base member 24 of golf bag 10; however, other suitable limited angular displacements or angles could be utilized to manipulate the forwardly angled presentation of second rack 110 and the "iron-type" golf clubs removably retained thereby.

Third rack 190 is preferably adapted to receive and removably retain "wedge-type" golf clubs and a putter club therein. More specifically, preferably formed on front side 190*a* of third rack 190 and disposed on lower portion 190*d* thereof is base tray 192, preferably comprising fully-closed recesses or slots 194, 196, 198 and 200 formed therein. Preferably disposed between slots 196 and 198, and extending upwardly from base tray 190, is elongated putter retaining tube 202, wherein putter retaining tube 202 functions to receive and house the shaft of a conventional putter club therein. Each slot 194, 196, 198 and 200 preferably comprises a depth dimensioned to retain the upper-most portion of the handle or shaft of a "wedge-type" golf club placed therein. Specifically, it is intended within the primary embodiment that approximately the first 6 inches of the handle portion of a "wedge-type" golf club be accommodated within a respective slot; however, it should be recognized that other suitable depths could be utilized to effectuate or facilitate ease of removal and/or retention of a golf club handle placed therein. It is contemplated in an alternate embodiment that base tray 192 of third rack 190 could comprise open-faced slots covered via a fabric retaining wall to retain the handle portions of "wedge-type" golf clubs and/or a putter club therein (i.e., equivalent to base trays 70 and 112 of first rack 60 and second rack 110, respectively). It is further contemplated that putter tube 202 could be replaced with a fully-closed recess or slot formed in base tray 192 of third rack 190.

Figure 1C:
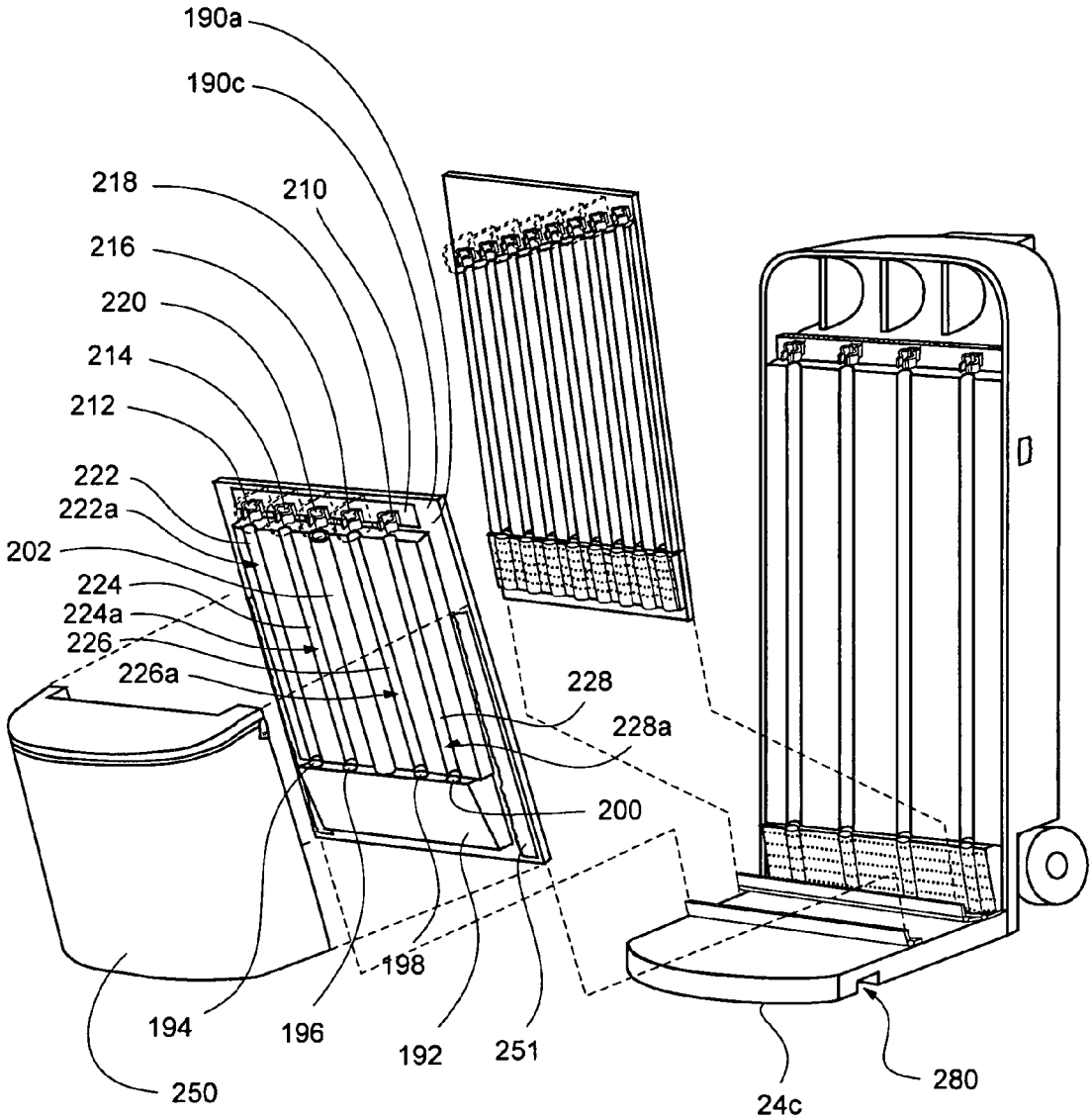
FIG. 1C is an exploded view of a golf bag according to a preferred embodiment of the present invention.

Preferably disposed on upper portion 190*c* of front side 190*a* of third rack 190 is retaining bar 210, preferably having retaining clasps 212, 214, 216, 218 and 220 extending therefrom and secured thereto, as best illustrated in FIG. 1C. Retaining clasps 212, 214, 216 and 218 are preferably aligned with slots 194, 196, 198, and 200, respectively, of base tray 192, wherein retaining clasp 220 is preferably aligned over putter retaining tube 202 of base tray 192, thereby facilitating substantially vertical retention of "wedge-type" golf clubs and a putter club therein. Specifically, preferably following placement of the handle of a golf club within a selected slot 194, 196, 198 or 200 of base tray 192, the respective retaining clasp 212, 214, 216 or 218 securely receives and removably engages a portion of the golf club shaft just aft of the golf club head. Similarly, preferably following placement of the shaft of a putter club within putter retaining tube 202 of base tray 192, retaining clasp 220 securely receives and removably engages a portion of the putter club shaft just aft of the putter club head.

Additionally, to facilitate recession of each "wedge-type" golf club within a particular clasp-and-slot arrangement, grooves 222, 224, 226 and 228 formed in front side 190*a* preferably extend from retaining clasps 212, 214, 216 and 218, respectively, to aligned slots 194, 196, 198 and 200, respectively, of base tray 192. Furthermore, grooves 222, 224, 226 and 228 preferably comprise different, brightly-colored strips 222*a*, 224*a*, 226*a* and 228*a* of adhesive tape, paint, or the like, to facilitate proper visual alignment of each clasp 212, 214, 216 and 218 with a corresponding slot 194, 196, 198 and 200, and thus the proper placement of a club therein.

Third rack 190 is also preferably lined with a rubber-sponge material, or other padded material, so as to protect the "wedge-type" golf clubs and putter club retained therein from harmful contact, scratching, scuffing, or the like. Additionally, rubber-sponge or padded dividers 232, 234, 236 and 238, preferably extend from, and are integrally formed with, front side 190*a*, thereby functioning to preclude contact amongst the club heads of each "wedge-type" golf club and putter club stored within rack 190. Specifically, divider 232 is preferably positioned between clasps 212 and 214, divider 234 is preferably positioned between clasps 214 and 220, divider 236 is preferably positioned between clasps 220 and 216, and divider 238 is preferably positioned between clasps 216 and 218, thereby separating each club/putter head from one another, and preventing harmful or damaging contact amongst same.

Figure 2A:
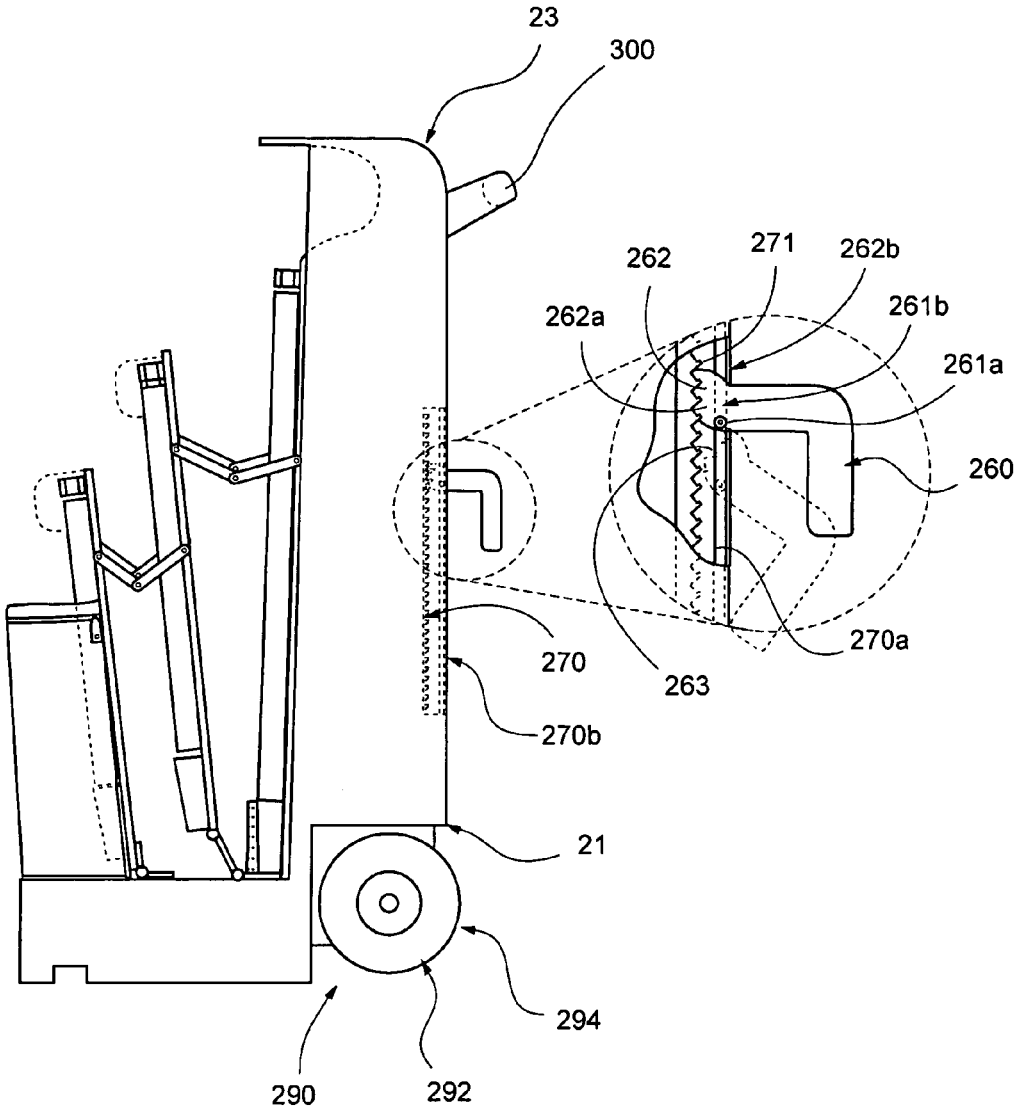
FIG. 2A is a side view of a golf bag according to a preferred embodiment of the present invention.
Figure 2B:
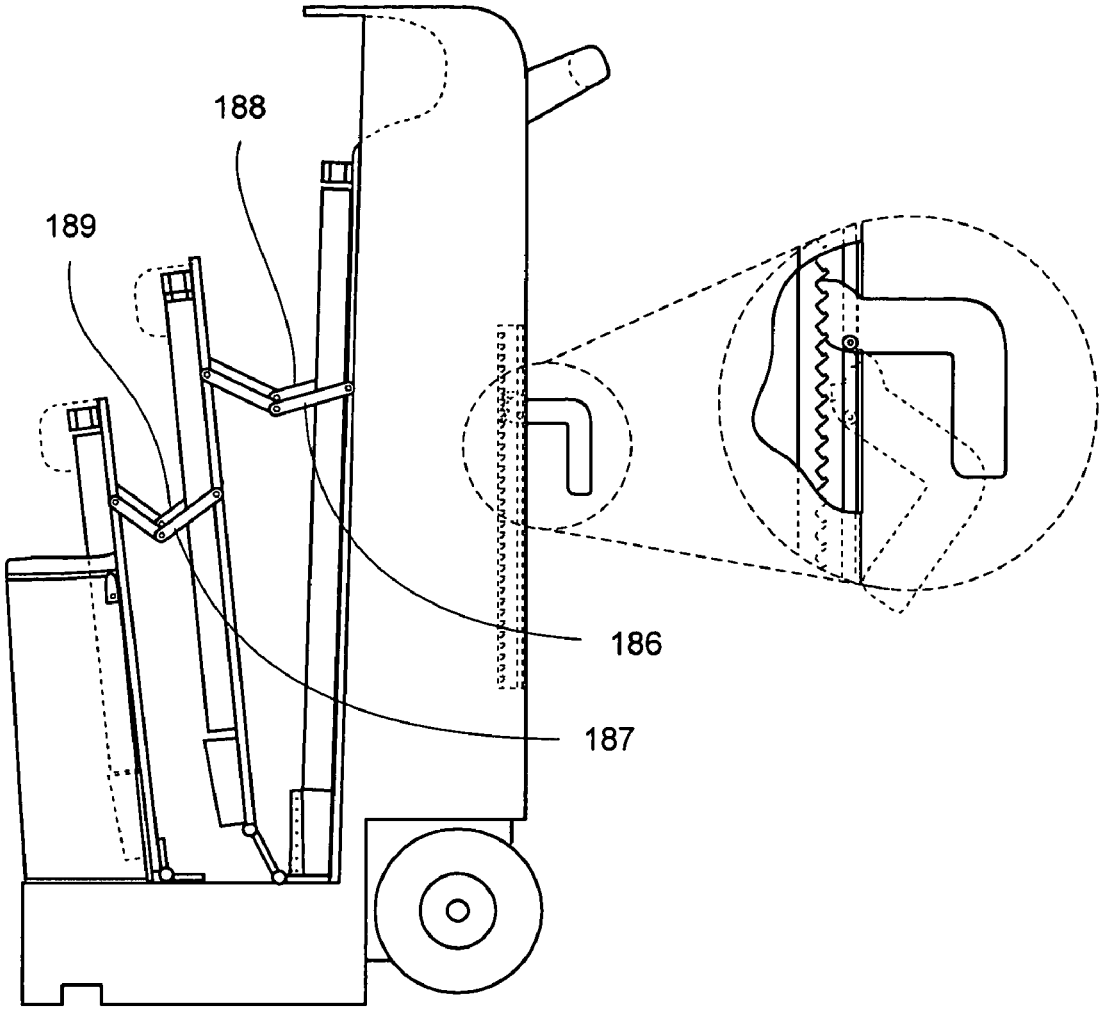
FIG. 2B is a side view of a golf bag according to a preferred embodiment of the present invention.

Preferably, and as best illustrated in FIGS. 2-2B, third rack 190 is pivotally connected to top side 24*a* of base member 24 of housing 20 via bearing hinge 240, preferably extending from top side 24*a* of base member 24, proximal to base tray 112 of second rack 110, to rear side 190*b* of third rack 190, proximate bottom edge 190*e* thereof. Preferably, and as more fully described below, the opening of bag 10, in conjunction with the weight of the golf clubs and putter carried by third rack 190, assist in promoting the gravitational falling and forwardly, limited angular displacement of third rack 190.

Specifically, the gravitational falling and angular displacement of third rack 190 is preferably limited via pivot hinges 187 and 189, or the like, extending from sides 190*f* and 190*g*, respectively, of third rack 190 to front inner edges 22*e* and 22*f* of upright member 22 of housing 20. Preferably, pivot hinges 187 and 189 limit the gravitational falling and angular displacement of third rack 190 to an approximately 60 degree angle relative to top surface 24*a* of base member 24 of housing 20; however, other suitable limited angular displacements or angles could be utilized to manipulate the forwardly angled presentation of third rack 190 and the "wedge-type" golf clubs and putter club removably retained thereby.

The forward gravitational falling and angular displacement of third rack 190 is further preferably limited upon contact of bottom edge 190*e* of third rack 190 with top surface 24*a* of base member 24, and via a relatively large storage compartment 250 removably affixed to forward side 190*a* of third rack 190, proximal the edges of sides 190*f* and 190*g* thereof, as more fully described below. Additionally, it should be recognized that the forward gravitational falling and pivoting of second rack 110 may assist in pushing against third rack 190, and thus, promote the gravitational falling or pivoting of same into a forwardly angled position.

As such, the collective forward gravitational falling and pivoting of second rack 110 and third rack 190, preferably functions to present each golf club placed within racks 60, 110 and 190 of bag 10 in an organized, spaced-apart, inverted arrangement for ease of removal and replacement of same.

It should be recognized that pivot hinges 186 and 188 of second rack 110, and pivot hinges 187 and 189 of third rack 190, when in an extended position (i.e., when second rack 110 and third rack 190 are forwardly angularly displaced), should be sufficiently frictional or tensioned to resist retracting when a previously removed golf club is subsequently replaced and snapped into a respective rack, thereby providing single-handed removal and replacement of golf clubs therein. However, it should be recognized that the combined weight of the clubs within racks 110 and 190, as well as storage compartment 250, functionally assist in maintaining racks 110 and 190 in a forward, angled position when a previously removed golf club is subsequently replaced and snapped therein (i.e., resist being pushed back into a recessed, upright or non-angled position). It is contemplated that pivot hinges 186, 187, 188 and 189 could possess releasable locking mechanisms that lock each pivot hinge 186, 187, 188 and 189 into an extended position, wherein pivot hinges 186, 187, 188 and 189 could then be subsequently retracted upon release of the locking mechanisms thereof.

Preferably, storage compartment 250 is removably affixed or securable to forward side 190*a* of third rack 190, proximal the edges of sides 190*f* and 190*g* thereof, via hook-and-loop fasteners 251; however, clasps, clips, zippers, snap-buttons, straps, ties, buckles, or the like, could also be utilized. Storage compartment 250 is removably fastened and disposed on forward side 190*a* of third rack 190 in such a manner so as to not obstruct access to tray 192 of third rack 190. Storage compartment 250 is preferably a multi-compartment zippered bag for storing golf balls, tees, gloves, towels, and other golf and/or personal accessories. It is further contemplated that storage compartment 250 could be either a soft cover or hard cover bag. It is still further contemplated that at least a portion of storage compartment 250 could be a food cooler.

Referring now more specifically to FIG. 2A, adjustable "hook-shaped" bracket 260 is preferably disposed within channel 270 vertically formed on exterior wall 22*b* of upright member 22, wherein bracket 260 preferably facilitates engagement of golf bag 10 to horizontal bars formed on the rear chassis of conventional golf carts. Specifically, sides 262*a* and 262*b* of first end 262 of bracket 260 preferably comprise cylindrical-shaped dowels or protrusions 261*a* and 261*b*, respectively, that preferably slidably engage opposing grooves 270*a* and 270*b*, respectively, formed within channel 270, thereby facilitating the vertical "riding" or slidable adjustment of bracket 270 therewithin. First end 262 of bracket 260 further preferably comprises a ribbed outer surface 263 adapted to interlock with ribs 271 formed along the length of channel 270. To facilitate tensioned adjustment and locking of bracket 260 with channel 270, bracket 260 is preferably internally spring-biased, wherein inward depression of bracket 260 via hooked-shaped second end 264 preferably releases ribbed surface 263 of first end 262 from interlocked engagement with ribs 271 of channel 270, thereby permitting the vertical adjustment of bracket 260 therewithin. Upon adjusting bracket 260 to a desired height, bracket 260 is released; springfully urging ribbed surface 263 thereof back into interlocking engagement with ribs 271 of channel 270, wherein bag 10 may then be secured to a horizontal bars formed on the rear chassis of conventional golf carts via hook-shaped second end 264 of bracket 260. Bracket 260 is preferably adjustable within channel 270 from heights of approximately 31 inches to approximately 36 inches from bottom side 24*b* of base member 24 so as to accommodate all current makes and models of golf carts. Additionally, to facilitate the secured engagement of bag 10 to the rear of the golf cart, groove or notch 280 is preferably formed on bottom side 24*b* of base member 24, proximal lower forward edge 24*c* thereof, wherein notch 280 is preferably dimensioned to engage an outer-most ridge or wall of a conventional golf bag storage area formed on most golf carts. Such a configuration preferably permits bag 10 to extend beyond the rear of the golf cart and provide free frontal access to the contents thereof.

Preferably disposed on lower portion 21 of exterior wall 22*a* of upright member 22, proximal base member 24, is rear mounted wheel assembly 290 comprising wheels 292 and 294 that sit preferably approximately 1 inch from the earthen ground/surface when bottom side 24*b* of base member 24 is seated substantially flush with therewith. Preferably, wheels 292 and 294 become operative upon tilting bag 10 beyond an approximately 65 degree angle, relative to the ground, via handle 300 integrally formed with upper portion 23 of exterior wall 22*a* of upright member 22. Although wheels 292 and 294 preferably sit approximately 1 inch from the ground, it is contemplated that wheels 292 and 294 may be positioned at a greater or lesser height therefrom so as to accordingly manipulated the tilting angle of bag 10 required to operate wheels 292 and 294. It is further contemplated that wheels 292 and 294 could be positioned so as to sit flush and/or extend beyond bottom side 24*b* of base member 24 when bottom side 24*b* is seated substantially flush with the ground, wherein such an embodiment could further incorporated wheel locks to prevent inadvertent movement or rolling of bag 10.

Figure 3:
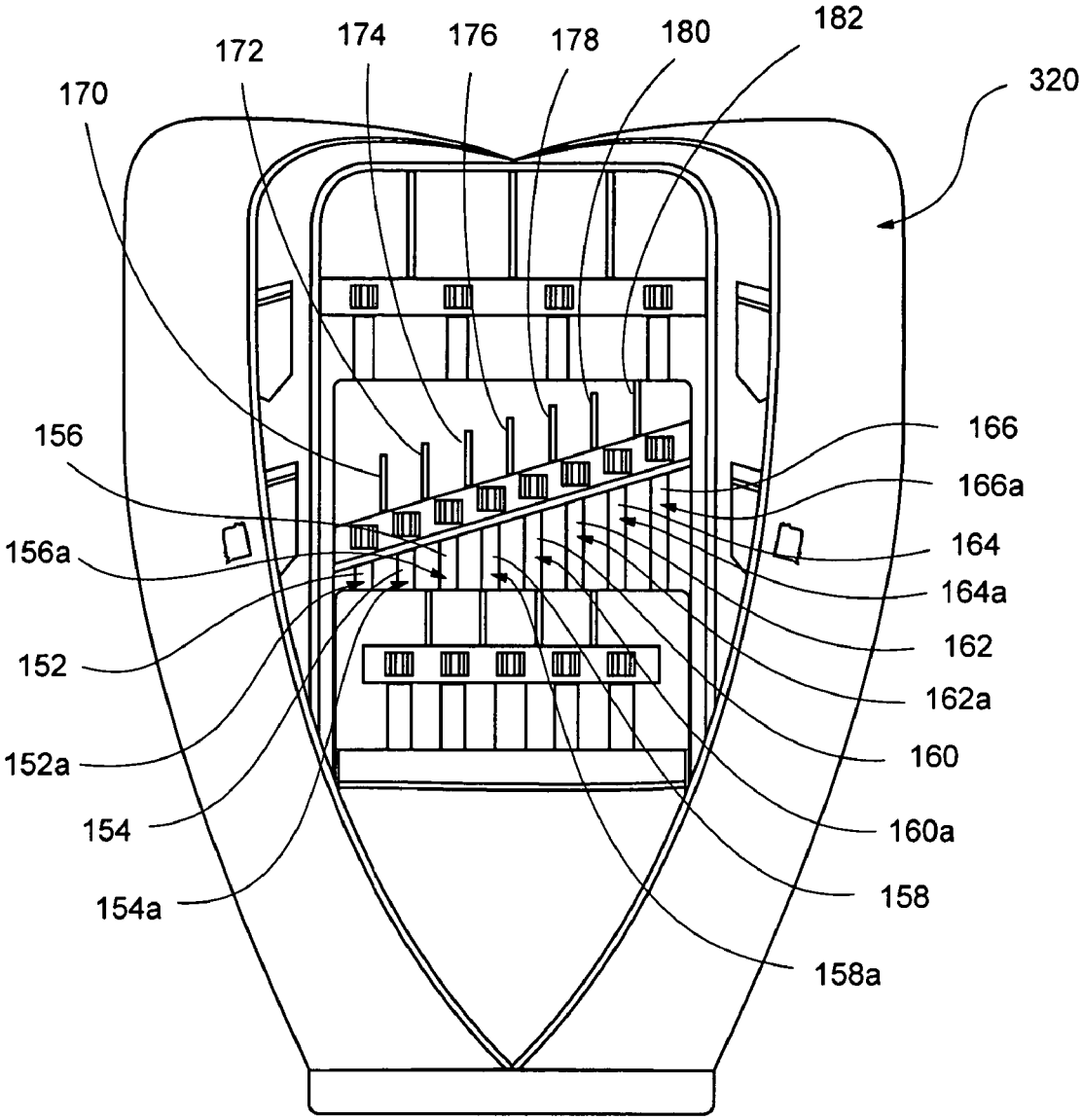
FIG. 3 is a front view of a golf bag according to a preferred embodiment of the present invention.
Figure 3A:
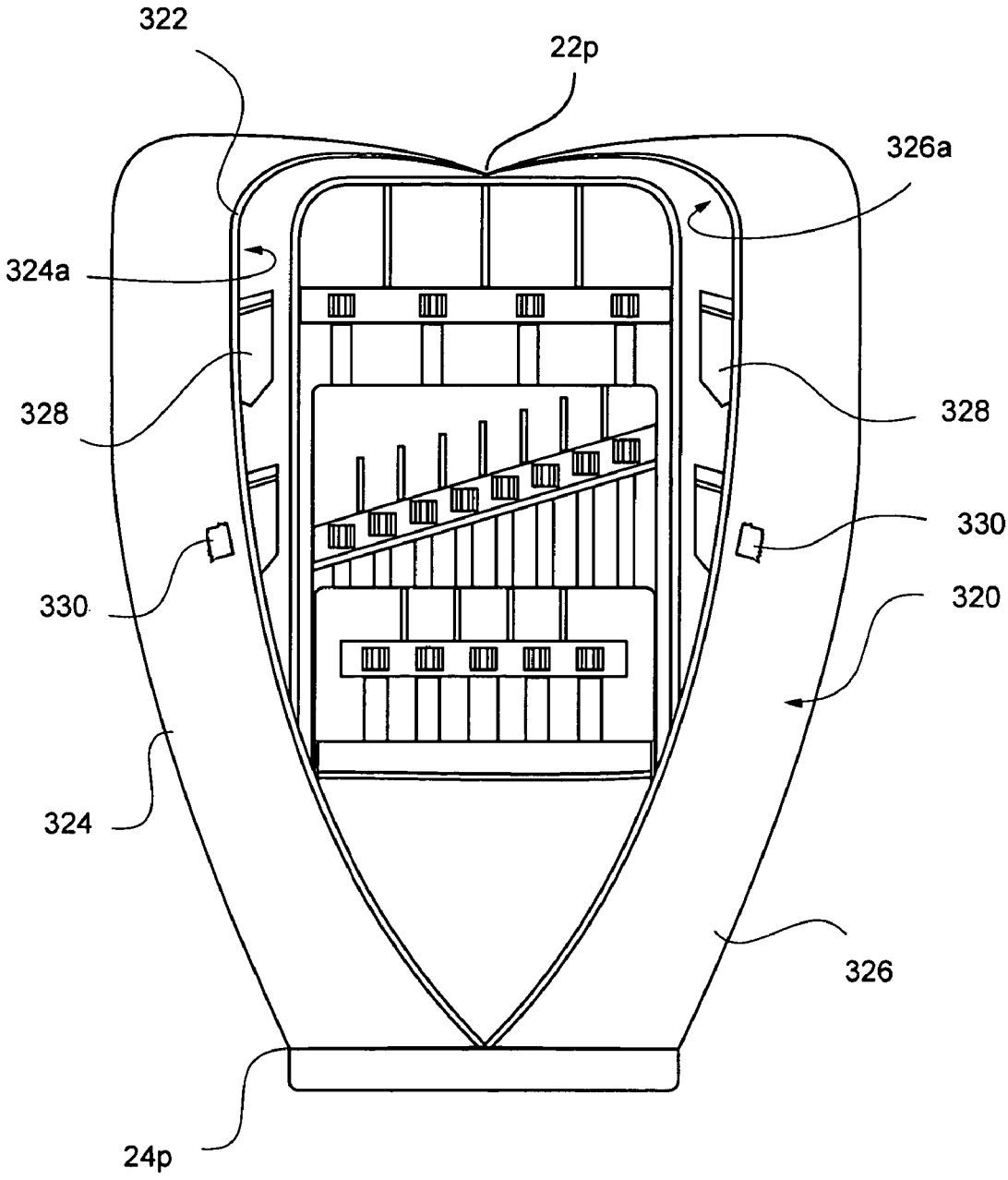
FIG. 3A is a front view of a golf bag according to a preferred embodiment of the present invention.
Figure 3B:
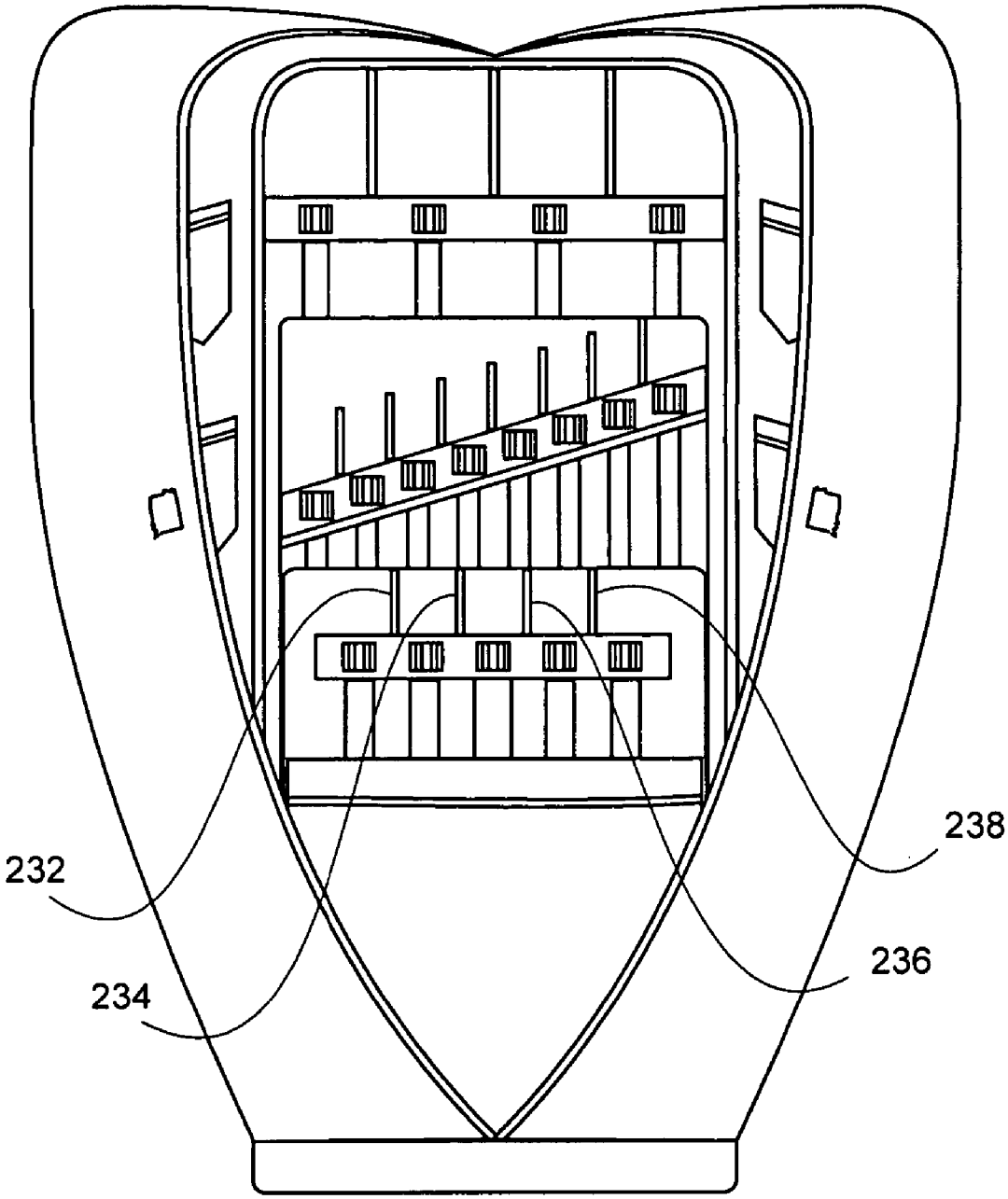
FIG. 3B is a front view of a golf bag according to a preferred embodiment of the present invention.

Referring now more specifically to FIGS. 3-3B, to shield or cover the interior of bag 10, and to protect the golf clubs retained therein, soft, front cover 320 preferably extends from, and is affixed along the entirety of front peripheral edge 22*p* of upright member 22, and along the upper peripheral edge 24*p* of base member 24. Preferably, zipper mechanism 322 centrally and vertically disposed on cover 320 provides access to the contents of golf bag 10, wherein "opening" or downwardly unzipping zipper mechanism 322 separates cover 320 into closure flaps 324 and 326. As described above, unzipping zipper mechanism 322 of cover 320 preferably results in gravitational falling and pivotal displacement of storage compartment 250, and racks 110 and 190, thereby presenting the golf clubs retained therein, as well as the golf clubs retained in rearwardly-disposed first rack 60. Inner surfaces 324*a* and 326*a* of closure flaps 324 and 326, respectively, preferably comprises a plurality of pockets and/or storage compartments 328, each accessible upon "peeling" back each closure flap 324 and 326, and fastening same to exterior wall 22*b* of upright member 22 via cooperative hook-and-loop fasteners 330 carried by closure flap 324 and 326 and exterior wall 22*b*; although other suitable fastening mechanisms could be utilized, such as, for exemplary purposes only, straps, ties, buckle-and-strap assemblies, snap-buttons, clips, or the like.

It is contemplated in an alternate embodiment that cover 320 could be in the form of a hard-cover, and, as such, possess hard-cover closure flaps mechanically separable via buckles, latches or like, instead of zipper mechanism 322.

Figure 4:
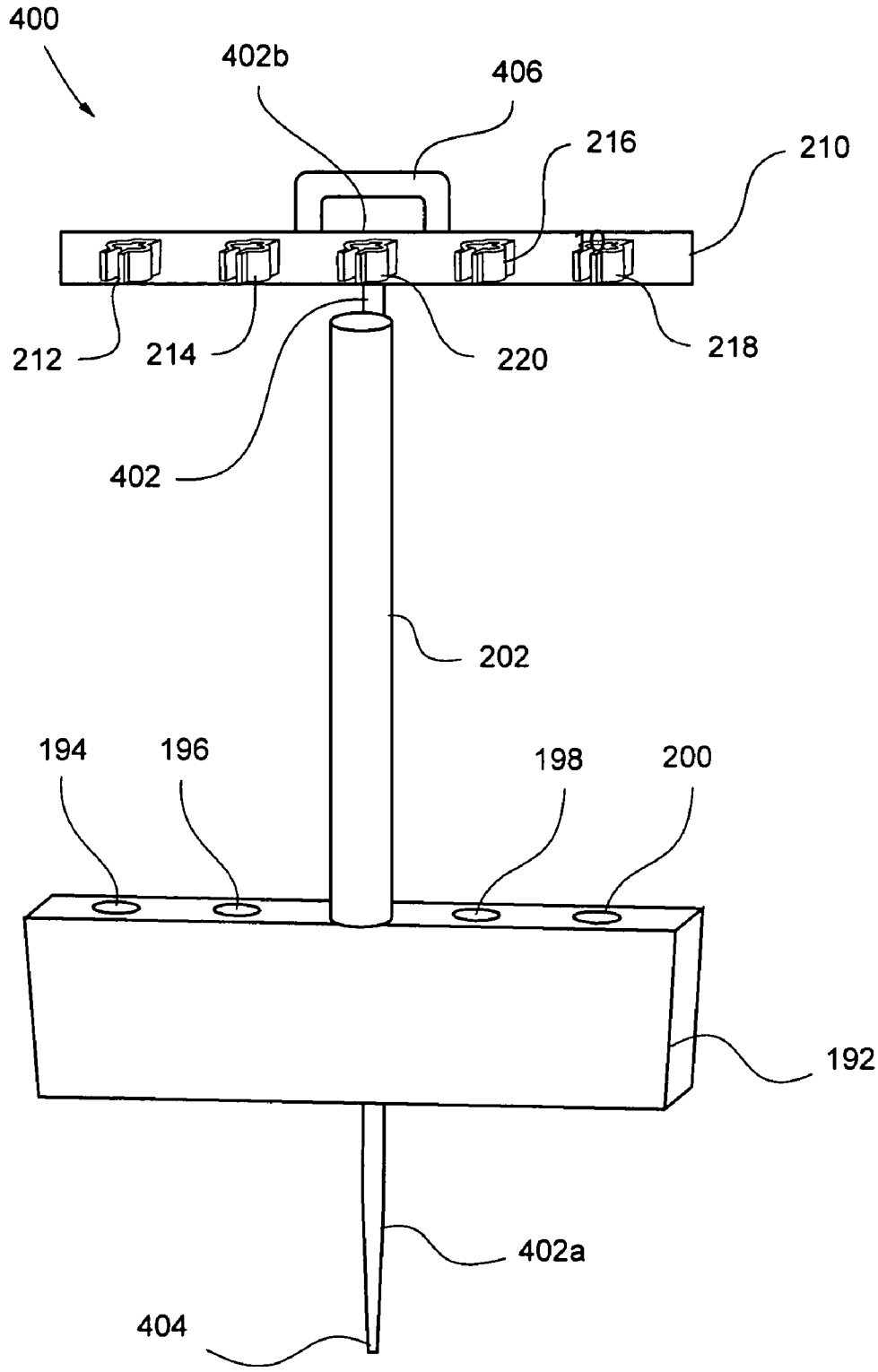
FIG. 4 is a perspective view of a golf bag according to an alternate embodiment of the present invention.
Figure 5:
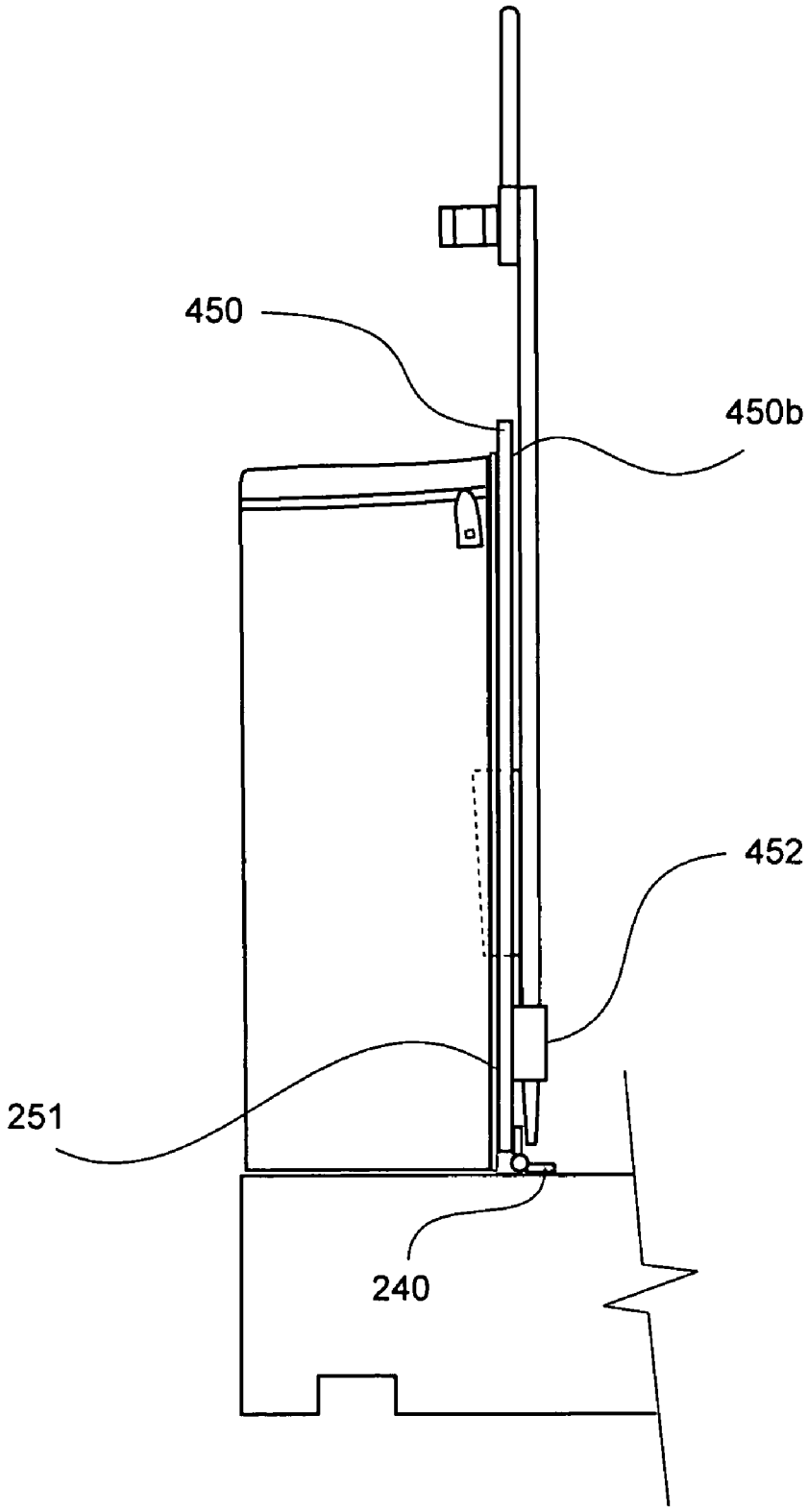
FIG. 5 is a perspective view of a golf bag according to an alternate embodiment of the present invention.

Referring now more specifically to FIGS. 4-5, illustrated therein is an alternate embodiment of golf bag 10, wherein the alternate embodiment of FIGS. 4-5 is substantially equivalent in form and function to that of the preferred embodiment detailed and illustrated in FIGS. 1-3B except as hereinafter specifically referenced. Specifically, the embodiment of FIGS. 4-5 replaces pivotally-affixed third rack 190, and removable storage compartment 250 thereof, with detachable third rack 400, wherein rack 400 is securely and removably supported by pivotally-affixed support plate 450, adapted to removably secure a storage compartment thereto. Specifically, similar to third rack 190, rack 400 includes retaining bar 210 with associated retaining clasps 212, 214, 216, 218 and 220, and base tray 192 with associated slots 194, 196, 198, and 200, as well as putter retaining tube 202 extending therefrom. However, in the present alternate embodiment, retaining bar 210 and base tray 192 are secured to, and opposingly positioned on, central support bar 402. Formed at first end 402*a* of central support bar 402 is stake or spike 404, wherein second end 402*b* comprises handle 406 integrally formed therewith. Stake or spike 404 is utilized to stake and secure detachable rack 400 into the earthen ground, thereby maintaining rack 400, and the golf clubs carried thereby, in an upright position, and off of wet or dew-covered grass, sand, or the like. Stake or spike 404 of rack 400 is received by open-ended retaining pocket 452 integrally formed with rear side 450*b* of support plate 450, wherein complete recession of spike 404 within pocket 452 results in extension of spike 404 therethrough. As best illustrated in FIG. 5, handle 406 assists in removing spike 404 from retaining pocket 452 of rack 450, and, as such, rack 400 in its entirety from golf bag 10, thereby permitting the transport of same, as well as the "wedge-type" golf clubs and putter club removably retained thereby. Front side 450*a* of support plate 450 is adapted to removably secure storage compartment 250 thereto via hook-and-loop fasteners 251, or the like. Additionally, similar to third rack 190, support plate 450 is pivotally connected to top side 24*a* of base member 24 of housing 20 via bearing hinge 240, extending from top side 24*a* of base member 24, proximal to base tray 112 of second rack 110, to rear side 250*b* of support plate 450, proximate bottom edge 450*e* thereof. As such, the opening of bag 10, in conjunction with the weight of the golf clubs and putter carried by rack 400, assist in promoting the gravitational falling and forwardly, limited angular displacement of third rack 400, support rack 450 and storage compartment 250.

Figure 6:
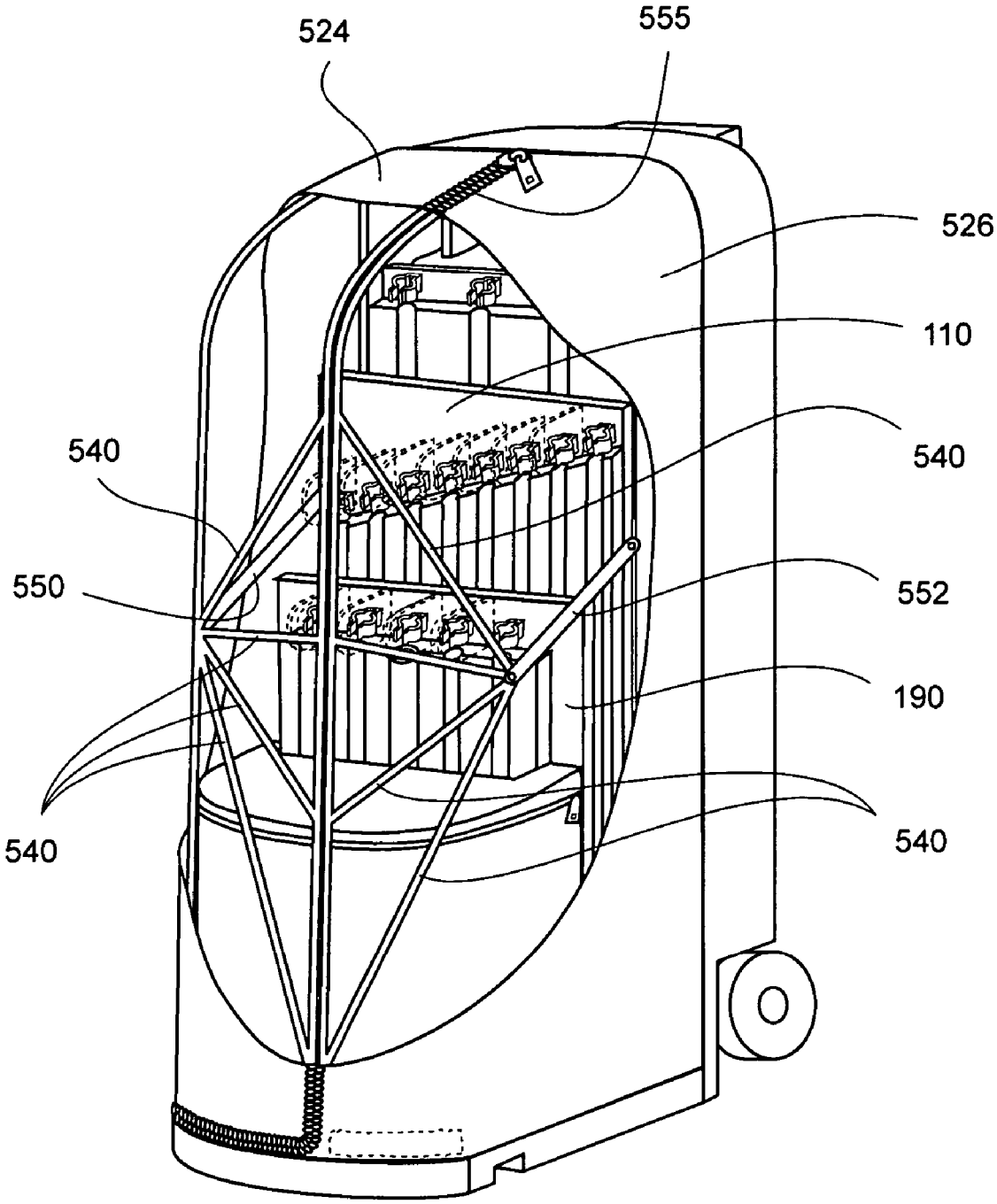
FIG. 6 is a front view of a golf bag according to an alternate embodiment of the present invention.

Referring now more specifically to FIG. 6, illustrated therein is an alternate embodiment of golf bag 10, wherein the alternate embodiment of FIG. 6 is substantially equivalent in form and function to that of the preferred embodiment detailed and illustrated in FIGS. 1-3B except as hereinafter specifically referenced. Specifically, the embodiment of FIG. 6 replaces soft closure flaps 324 and 326 with closure flaps 524 and 526, wherein closure flaps 524 and 526 comprise a plurality of tensioned ribs so as to facilitate the tensioned closing and opening of same. It is contemplated in such an embodiment that pivot arms 550 and 552, or other connecting arms or devices, would extend from second rack 110, and subsequently each branch off into a plurality of tensioned ribs 540, wherein ribs 540 would be attached to the front edges of closure flaps 524 and 526. Unzipping of zipper mechanism 555 tensionally urges closure flaps 524 and 526 into an open and completely folded-back position, thereby facilitating the outward pushing and gravitational falling of second rack 110 and third rack 190. The uptake or retraction of second rack 110 and third rack 190 is facilitated via the tensioned closing of closure flap 524 and 526.

Figure 7:
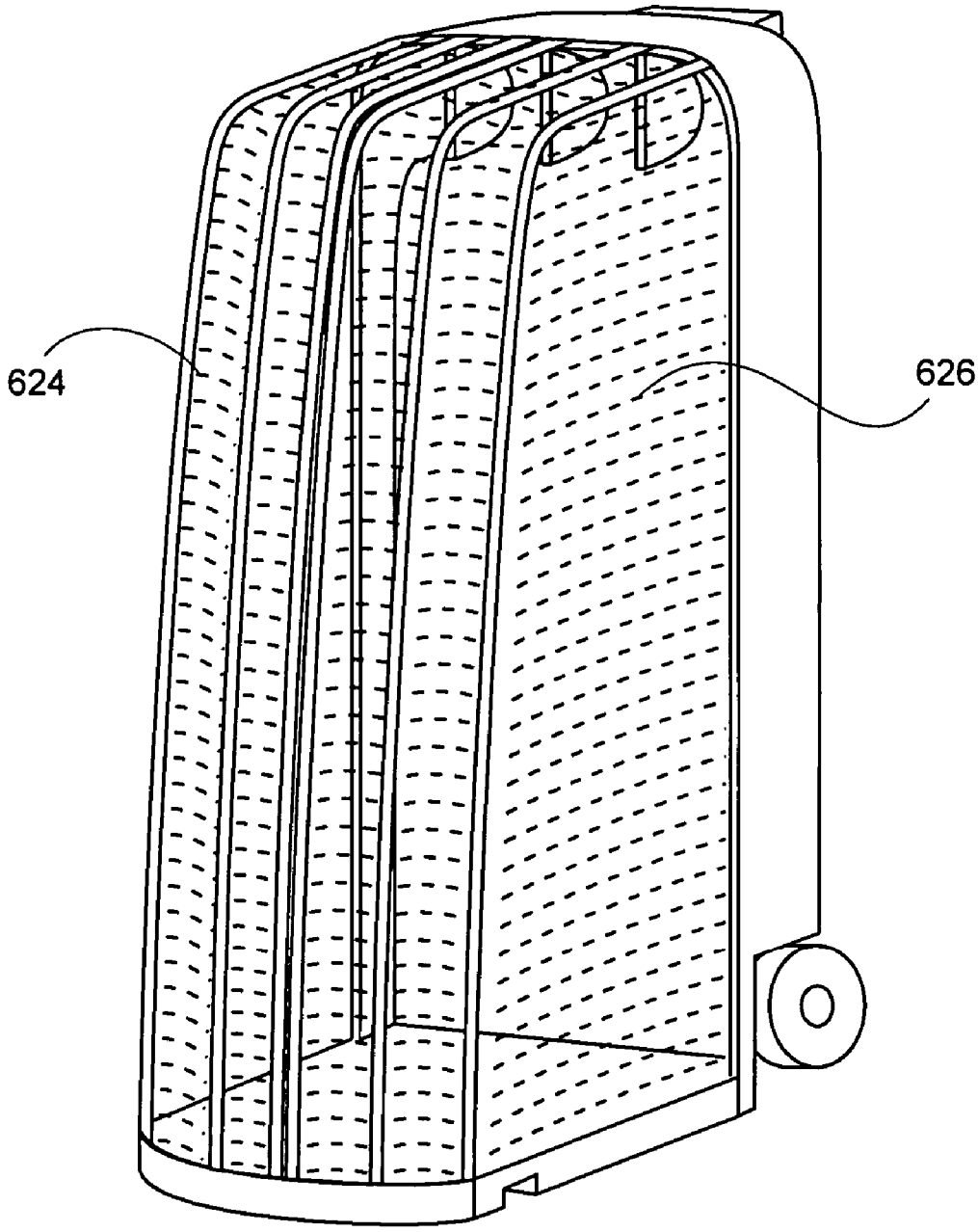
FIG. 7 is a front view of a golf bag according to an alternate embodiment of the present invention; and, FIG. 8 is a rear perspective view of a golf bag according to an alternate embodiment of the present invention.

Referring now more specifically to FIG. 7, illustrated therein is an alternate embodiment of golf bag 10, wherein the alternate embodiment of FIG. 7 is substantially equivalent in form and function to that of the preferred embodiment detailed and illustrated in FIGS. 1-3B except as hereinafter specifically referenced. Specifically, the embodiment of FIG. 7 replaces soft closure flaps 324 and 326 with accordion-like or pleated closure flaps 624 and 626, wherein closure flaps 624 and 626 comprise internal ribbing to facilitate the pleated extension and retraction of each closure flaps 624 and 626.

Figure 8:
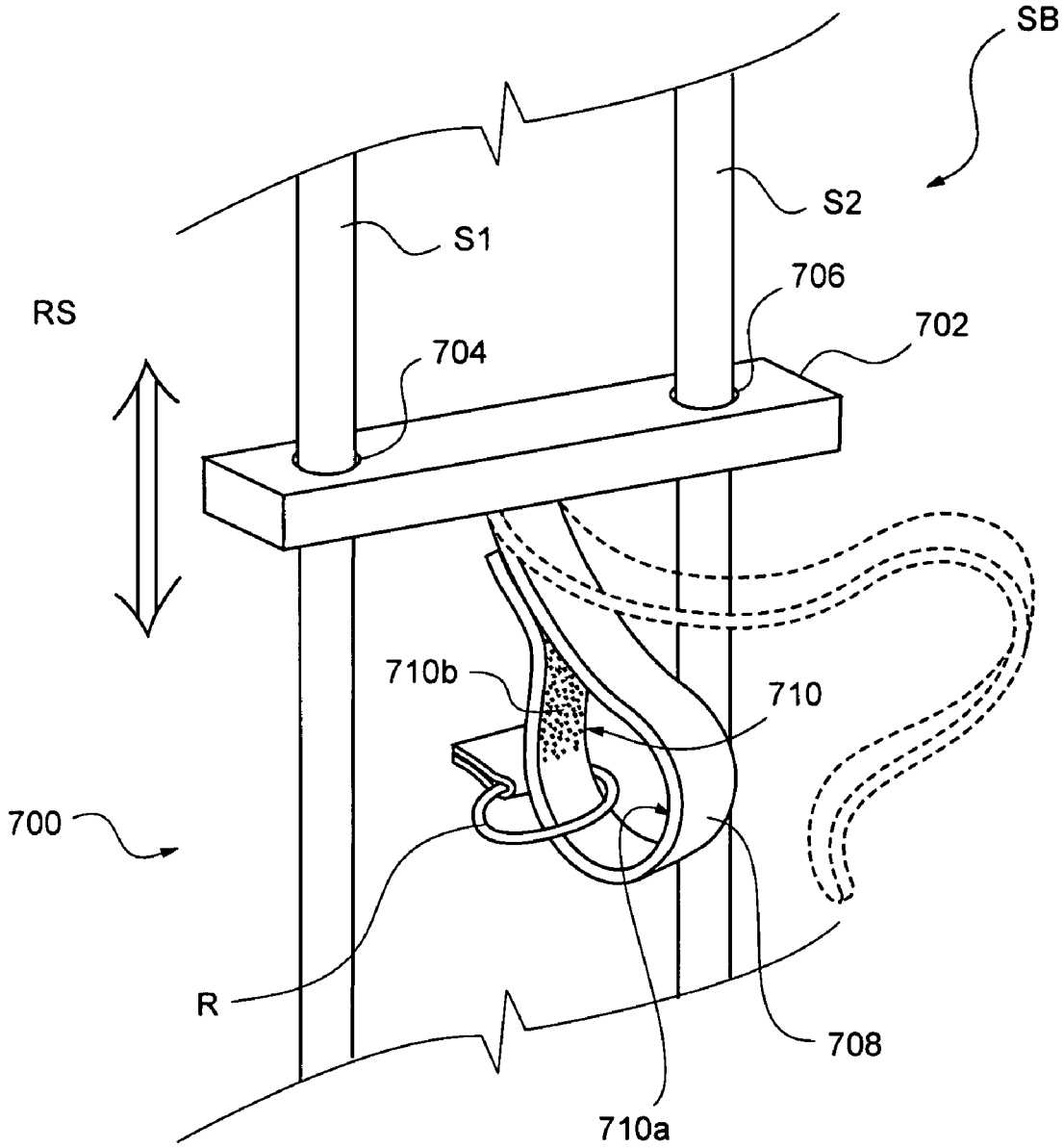

Referring now more specifically to FIG. 8, illustrated therein is an alternate embodiment of golf bag 10, wherein the alternate embodiment of FIG. 8 is substantially equivalent in form and function to that of the preferred embodiment detailed and illustrated in FIGS. 1-3B except as hereinafter specifically referenced. Specifically, adjustable bracket 260 is replaced via adjustable strap assembly 700, wherein strap assembly 700 functions as both a handle, and further facilitates engagement of golf bag 10 to horizontal bars formed on the rear chassis of conventional golf carts. That is, conventional soft-body golf bags often include a plurality of interiorly and/or exteriorly disposed structural support spines to impart a desired rigidity to the golf bag, wherein such spines are also located on the rear of the golf bag. Additionally, many such conventional golf bags often include a plurality of rings disposed on the rear side thereof, wherein such rings are utilized to carry towels, hats, or the like. Furthermore, conventional golf bags incorporate a rearwardly disposed tote handle to facilitate carriage of the golf bag, wherein such a handle is often disposed between two rearwardly disposed support spines. As such, the present alternate embodiment contemplates replacing the conventional tote handle of available soft-body golf bags with strap assembly 700. Specifically, strap assembly 700 utilizes rear support spines S1 and S2 on rear side RS of soft-body golf bag SB, wherein an adjustable slide bar 702 is slidably engaged therewith via throughholes 704 and 706 formed therethrough; it should be recognized that although spines S1 and S2 are illustrated as generally cylindrically-shaped support spines, support spines of other shapes could be equipped with slide bar 702, wherein throughholes 704 and 706 thereof would be suitable shaped to facilitate slidable engagement therewith. Extending from slide bar 702 is strap 708, wherein strap 708 comprises hook portion 710*a* and loop portion 710*b* of hook-and-loop fastener 710. Threading hook-and-loop fastener 710 through conventional ring R, and thereafter engaging hook portion 710*a* with loop portion 710*b* forms a functional handle in which to tote or carry golf bag SB. Disengaging hook portion 710*a* from loop portion 710*b* releases strap 708 from ring R, and allows slide bar 702 to slidably travel through the lengths of spine S1 and S2. As such, strap 708 may be looped around a horizontal bar formed on the rear chassis of conventional golf carts, and hook portion 710*a* and loop portion 710*b* refastened to secure golf bag SB thereto, wherein notch 280 of base member 24 may also engage an outer-most ridge or wall of the golf bag storage area as describe above. It should be recognized that slide bar 702 could be modified to adapt to only one spine or, alternatively, more than two spines of a golf bag. It should further be recognized that strap assembly 700 could be adapted to golf bag 10 upon manufacturing golf bag 10 with a "soft" upright member 22 and/or exterior wall 22*b* having a plurality of support spines disposed therethroughout. It is contemplated that hook-and-loop fastener 710 could be replaced via any other suitable releasably fastenable mechanisms, such as, for exemplary purposes only, snap-buttons, buckles, and the like.

It is contemplated in still another alternate embodiment that housing 20 could utilize a single closure flap having a side-disposed zipper mechanism or the like.

In yet another alternate embodiment, it is contemplated that the recessed inner wall 22*a* and/or exterior wall 22*b* of housing 20 could incorporate an extendable rain/debris cover adapted to shield bag 10, in either an opened or closed state, from the harsh elements of weather, sand, or other debris.

Although the retaining clasps described above are preferably utilized to securely and removably engage a portion of each club shaft just aft of each club head, it is contemplated in an alternate embodiment that other suitable retaining mechanisms could be utilized, such as for exemplary purposes only, latches, clips, clamps, straps, straps of hook-and-loop fastener, ties, hooks, spring-loaded retaining pins, and/or the like.

It is further contemplated in an alternate embodiment that the base trays of each rack 60, 110 and 190 could be replaced with retaining clasps, each dimensioned and adapted to securely and removably engage the handle portion of a golf club.

Although the gravitational falling and angular displacement of second rack 110 and third rack 190 is preferably controlled/limited via pivot hinges, it is contemplated in an alternate embodiment that other suitable pivotally limiting devices could be utilized, such as, for exemplary purposes only, straps, elastic straps, ropes, springs, fabric sections, hydraulic devices, pneumatic devices, or the like.

It is further contemplated in an alternate embodiment that the base trays of each rack 60, 110 and 190 could be replaced with latches, clips, clamps, straps, straps of hook-and-loop fastener, ties, hooks, spring-loaded retaining pins, and/or the like, for securely and removably engaging the handle portions of golf clubs.

It is contemplated in still another alternate embodiment that racks 60, 110 and 190 could each be selectively removable and/or pivotable.

It is contemplated in still a further alternate embodiment that, if desired, golf bag 10 could be manufactured so that racks 60, 110, 190 and 400 comprise long, tubular retaining slots or structures to house each golf club, wherein such tubular retaining slots could be incorporated either in conjunction with or in replacement of the retaining clasps described herein.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A golf bag, comprising:

a pivotal rack adapted to gravitationally fall to a limited angular displacement, said rack further adapted to removably retain at least one golf club, at least one retaining clip disposed on said rack, said at least one retaining clip adapted to securely and removably engage a portion of the at least one golf club, a base tray disposed on said rack, said base tray comprising at least one slot for securely and removably receiving a portion of the at least one golf club, a brightly-colored strip, extending from said at least one retaining clip to said at least one slot of said base tray to facilitate proper visual alignment of said at least one retaining clip with at least one slot, and thus proper placement of the golf club therewithin.

2. The golf bag of claim 1, further comprising at least one adjustable handle for securing said golf bag to a golf cart.

3. The golf bag of claim 2, further comprising at least on notch formed on an underside of said golf bag, said notch adapted to engage a portion of the golf cart to facilitate support of said golf bag thereon.

4. The golf bag of claim 1, further comprising frontally disposed closure flaps.

5. The golf bag of claim 4, wherein said closure flaps comprise a plurality of pockets and compartments disposed on the inner sides thereof.

6. The golf bag of claim 1, wherein the gravitational falling and angular displacement of said rack is limited via pivot hinges.

7. A golf bag, comprising:

a detachable rack adapted to pivotally and gravitationally fall to a limited angular displacement, said detachable rack further adapted to removably retain at least one golf club, at least one retaining clip disposed on said rack, said at least one retaining clip adapted to securely and removably engage a portion of the at least one golf club, a base tray disposed on said detachable rack, said base tray comprising at least one slot for securely and removably receiving a portion of the at least one golf club, a brightly-colored strip, extending from said at least one retaining clip to said at least one slot of said base tray to facilitate proper visual alignment of said at least one retaining clip with at least one slot, and thus proper placement of the golf club therewithin.

8. The golf bag of claim 7, further comprising at least one adjustable handle for securing said golf bag to a golf cart.

9. The golf bag of claim 8, further comprising at least on notch formed on an underside of said golf bag, said notch adapted to engage a portion of the golf cart to facilitate support of said golf bag thereon.

10. The golf bag of claim 7, further comprising a removable storage compartment.

11. The golf bag of claim 7, wherein said detachable rack comprises a stake or spike utilized to stake and secure said detachable rack into an earthen surface, thereby maintaining said detachable rack, and the at least one golf club carried thereby, in an upright position, and off of the earthen surface.

12. The golf bag of claim 7, further comprising frontally disposed closure flaps.

13. The golf bag of claim 12, wherein said closure flaps comprise a plurality of pockets and compartments disposed on the inner sides thereof.

14. The golf bag of claim 7, wherein the gravitational falling and angular displacement of said rack is limited via pivot hinges.

15. The golf bag of claim 7, further comprising a wheel assembly and a handle, said wheel assembly operative upon tilting said golf bag via said handle such that wheels of said wheel assembly contact an underlying surface.

* * * * *